US006095829A

United States Patent [19]

Burland

[11] Patent Number: 6,095,829

[45] Date of Patent: Aug. 1, 2000

[54] ELECTRICAL CONNECTION AND CONNECTORS

[75] Inventor: Gregory Neil Burland, London, United Kingdom

[73] Assignee: Smiths Industries Public Limited Company, London, United Kingdom

[21] Appl. No.: 09/192,558

[22] Filed: Nov. 17, 1998

[30] Foreign Application Priority Data

Dec. 19, 1997 [GB] United Kingdom ..... 9726706

[51] Int. Cl.[7] ..... H01R 4/66

[52] U.S. Cl. ..... 439/98; 174/78

[58] Field of Search ..... 439/98; 174/78

[56] References Cited

U.S. PATENT DOCUMENTS

| | | | |
|---|---|---|---|
| 4,205,888 | 6/1980 | Wade . | |
| 4,790,765 | 12/1988 | Ehrenfels et al. | 439/98 |
| 5,199,891 | 4/1993 | Reed | 439/98 |

FOREIGN PATENT DOCUMENTS

| | | | |
|---|---|---|---|
| 224430 | 11/1924 | United Kingdom . | |
| 786879 | 11/1957 | United Kingdom . | |
| 2034160 | 5/1980 | United Kingdom . | |
| 2232020 | 11/1990 | United Kingdom | 439/98 |
| 2289579 | 11/1995 | United Kingdom . | |
| 2312569 | 10/1997 | United Kingdom . | |

*Primary Examiner*—Gary F. Paumen

*Attorney, Agent, or Firm*—Pollock, Vande Sande & Amernick

[57] ABSTRACT

Connection is made to the braided screening sleeves of wires in a cable by means of a resilient plastics clip of omega section including a metal insert attached with a fine wire. The clip resiliently urges the surface of the metal insert into contact with the screen so that it can be connected to ground by the fine wire. The clips are staggered along the length of the cable so that the overall diameter of the cable is not significantly increased in the region of the clips.

6 Claims, 2 Drawing Sheets

ELECTRICAL CONNECTION AND CONNECTORS

BACKGROUND OF THE INVENTION

This invention relates to electrical connection and connectors.

The invention is more particularly concerned with connectors for making electrical connection to a screening sleeve of an electrical wire.

An electrical connection to the screening sleeve of an electrical wire preferably has a low resistance and the connection is preferably of a kind that can be easily made and removed for servicing. Where the screening sleeve is braided, it is preferable that the connection can be made without the need to separate the braid from the signal conductor. Connection can be made to the screening sleeve by removing any outer insulating layer to expose the screening sleeve and rigidly clamping a connector about the screening sleeve. Such a connection relies on the resilient nature of the insulator around the signal conductor to provide a clamping force urging the screening sleeve against the inside of the conductor. This might make an effective connection initially but becomes less effective over time because of the tendency of the insulator to creep and thereby reduce the contact pressure.

SUMMARY OF THE INVENTION

It is an object of the present invention to provide an improved connector for making connection to a conductive sleeve of a wire.

According to one aspect of the present invention there is provided an electrical connector for making connection to a conductive sleeve of a wire of the kind comprising at least one inner conductor and at least one insulating sleeve extending around each respective conductor, the conductive sleeve extending around each insulating sleeve and being exposed at least along a part of its length on the outer surface of the wire, the connector comprising a resilient member and an electrically-conductive surface, and the resilient member being arranged resiliently to clamp the conductive surface against the conductive sleeve.

The resilient member may be a clip, which may be of omega shape in section. The resilient member may be of plastics material, the conductive surface being provided by a metal member within the resilient member. Alternatively, the resilient member may be of a resilient metal such as a resilient helical wire arranged to apply a radially-inward pressure to the conductive sleeve.

According to another aspect of the present invention there is provided an assembly of a wire of the kind comprising at least one inner conductor, at least one insulating sleeve extending around each respective conductor and a conductive sleeve extending around each insulating sleeve and exposed at least along a part of its length on the outer surface of the wire, the assembly including an electrical connector of the type described above gripping the conductive sleeve of the wire.

The assembly preferably includes a plurality of wires and a plurality of connectors, one mounted on each wire, the connectors being located at different points along the length of the wires.

An assembly of a cable and several connectors, according to the present invention, will now be described, by way of example, with reference to the accompanying drawings.

DETAILED DESCRIPTION OF THE PREFERRED EMBODIMENTS

Figure 1:
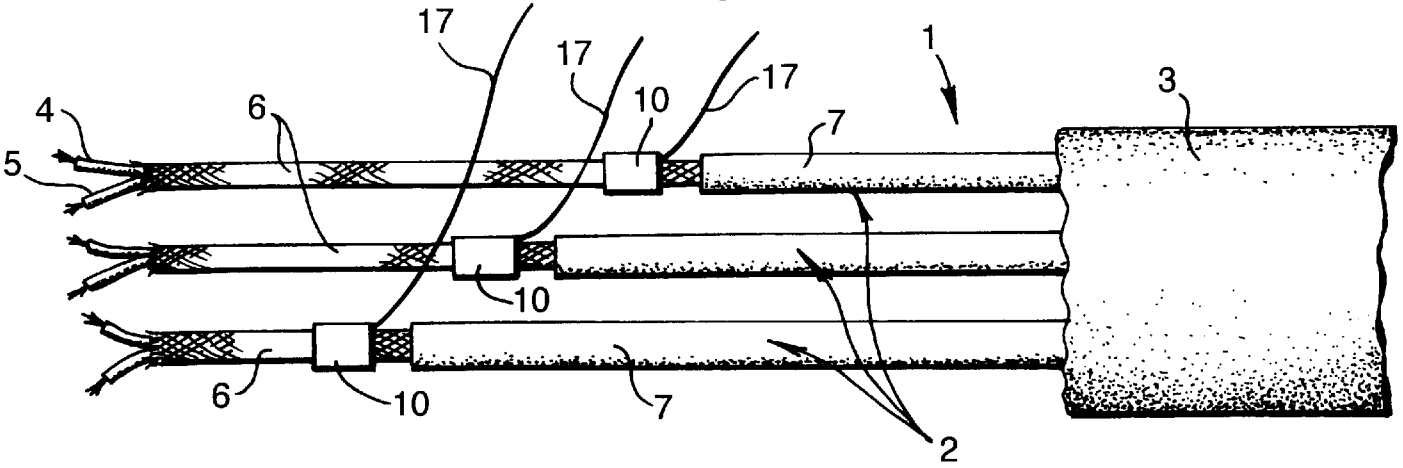
FIG. 1 is a side elevation view of a cable with connectors.
Figure 2:
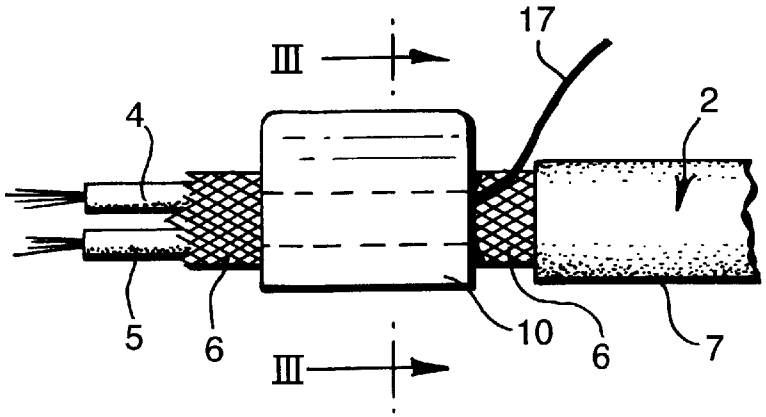
FIG. 2 is a plan view of one of the connectors.
Figure 3:
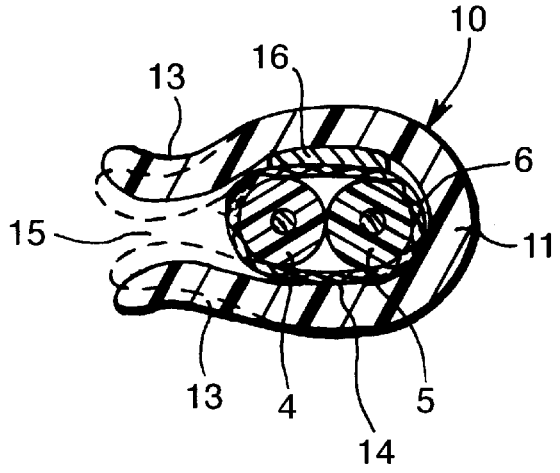
FIG. 3 is a sectional side elevation of the connector of FIG. 2 along the line III—III.

With reference first to FIGS. 1 to 3, the cable 1 shown in FIG. 1 has several wires 2, only three of which are shown, extending within an outer common casing 3. Each wire 2 has a twisted-pair of insulated signal conductors 4 and 5 extending within a common screening sleeve 6 of braided wire filaments. The wire could have a single conductor, or more than two conductors, if desired. The screening sleeve 6 is insulated along its length by an outer plastics jacket 7.

The outer plastics jacket 7 of each wire 2 is stripped away from its end to expose the underlying screening sleeve 6 so as to enable electrical connection to be made to the different screening sleeves. The length by which the outer insulation 7 is removed is different for each wire so that connection can be made to the different screening sleeves at different points along the length of the cable 1. In a cable having many wires, it is important to ensure that the connectors do not add to the width of the cable. Typically, connection is made to the screening sleeves within a coupling or other housing (not shown) into which the end of the cable 1 extends.

Connection is made to the screening sleeves 6 by means of respective clip connectors 10. Each clip 10 has a body 11 of a springy, resilient plastics material, such as unfilled PEEK. The body 11 is of channel shape and of omega "Q" section having two curved arms 13 belled outwardly away from one another towards their base to form a receiving region 14 and curved inwardly towards one another towards their free end to form a restricted region 15 with a width smaller than that of the receiving region. At their free ends, the arms 13 are flared outwardly to form a flared opening to the restricted region 15. The clip 10 also has a conductive member 16 in the form of a metal strip, such as of copper beryllium, extending along the length of the inside of the clip and secured to one of the arms 13 in the receiving region 14. The inward-facing surface of the conductive strip 16 is exposed for contact with a wire extending within the clip. It will be appreciated that a similar conductive member could also be secured to the opposite arm. The metal strip 16 is soldered or otherwise attached to a fine wire 17 extending away from the clip 10 and making connection to a ground plane, not shown.

The dimensions and size of the clip connector 10 in relation to those of a wire 2 are such that the clip can be pushed onto the wire, in the region where the outer insulating jacket 7 has been removed, and the arms 13 of the clip resiliently urge the metal strip 16 into contact with the screening sleeve 6. That is, the thickness of the wire 2 where the screen 6 is exposed is slightly greater than the internal width of the receiving region 14 in its natural state. The wire 2 is retained in the receiving region 14 of the clip 10, the thickness of the wire being sufficient to keep the arms 13 deflected slightly outwardly from their natural state, shown in broken lines. In this way, even if the insulation 7 on the signal conductors 4 and 5 should creep under the prolonged pressure exerted by the arms 13 of the clip 10, the arms would still apply a resilient force urging the metal strip 16 into effective electrical contact with the screening sleeve 6.

The connector clip 10 thereby provides effective, prolonged electrical connection to a screening sleeve 6, or the like. It can be easily made at low cost and can have a low weight and profile, which is particularly important in multi-wire cables or connectors. The profile of the connector 10 can be smooth to reduce the risk of damage to adjacent wires. The connector 10 can also be connected and removed from the side of the wires 2 without the need to break electrical connection to the signal conductors 4 and 5.

Instead of making the connector clip from an electrically-insulative, plastics material and having a separate conductive member to make contact with the screening sleeve, the entire clip could be of a resilient, electrically-conductive material.

Figure 4:
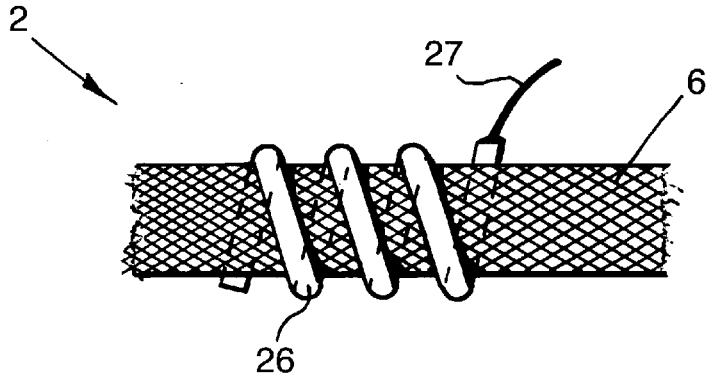
FIG. 4 illustrates an alternative connector on a wire.
Figure 5:
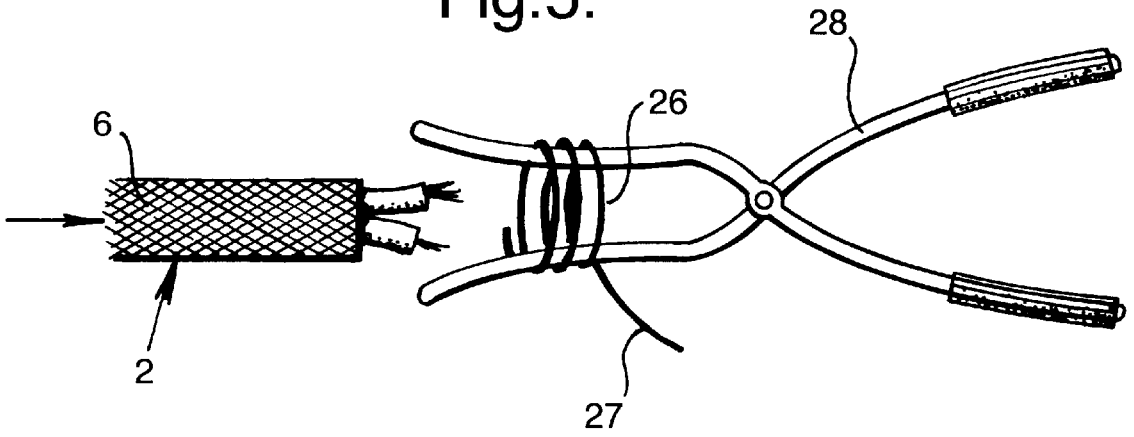
FIG. 5 illustrates the connector of FIG. 4 during assembly onto the wire.

There are various other forms of connector suitable for making connection to a conductive sleeve of a wire that would be capable of urging a conductive member against the conductive sleeve with a resilient force. One example is shown in FIGS. 4 and 5. In this, the conductive member is in the form of a springy, resilient helical metal wire 26, attached at one end to a fine wire 27 by which connection is made to the ground plane. The natural internal diameter of the helix 26 is chosen to be less than the external diameter of the screening sleeve 6. To load the helix 26 onto a wire 2, the helix is compressed axially and is expanded radially, as shown in FIG. 5, using a dilator tool 28. The radially-expanded helix 26 can then be slipped onto the appropriate wire 2. When the tool 28 is removed, the helix 26 retracts radially and expands axially about the screening sleeve 6 to exert a resilient, radially-inward pressure on the sleeve. Alternatively, the connector could be made of a shape-memory effect material, in which case it would be heated to an expanded state, slipped onto the wire and allowed to cool and revert to a non-expanded state where it applies a resilient pressure to the sleeve.

What I claim is:

1. An assembly comprising a cable and a plurality of electrical connectors, wherein said cable comprises a plurality of wires, wherein each wire comprises an inner conductor, an insulating sleeve extending around the conductor, a conductive sleeve extending around the insulating sleeve and an outer insulating jacket extending around the outside of the conductive sleeve and stripped back in a region to expose a part of said conductive sleeve, wherein each said connector comprises a channel shape resilient member, an electrically-conductive surface within said resilient member and a second wire connected with said electrically-conductive surface, and wherein each said resilient member resiliently clamps a respective conductive surface against a respective conductive sleeve of each said wire in said region so that said second wires make electrical connection with respective ones of said conductive sleeves.

2. An assembly according to claim 1, wherein the resilient member is a clip.

3. An assembly according to claim 2, wherein the clip is of omega shape in section.

4. An assembly according to claim 1, wherein the resilient member is of a plastics material, wherein said connector includes a metal member mounted with said resilient member, and wherein conductive surface is provided by said metal member.

5. An assembly according to claim 1, wherein the resilient member is of a resilient metal.

6. An assembly according to claim 1 including a plurality of said wires and a plurality of said connectors, one mounted on each wire, and wherein each said connector is located at a different point along the length of the wires.

* * * * *